US005178746A

United States Patent [19]

Darnall et al.

[11] Patent Number: 5,178,746

[45] Date of Patent: Jan. 12, 1993

[54] METHOD FOR PURIFICATION OF TRIVALENT CHROMIUM ELECTROPLATING BATHS

[75] Inventors: Dennis W. Darnall, Mesilla; Robert A. McPherson; Jorge L. Gardea-Torresdey, both of Las Cruces, all of N. Mex.

[73] Assignee: Bio-Recovery Systems, Inc., Las Cruces, N. Mex.

[21] Appl. No.: 609,350

[22] Filed: Nov. 5, 1990

[51] Int. Cl.[5] ..... C25D 3/06; C01G 37/00; B01J 39/00

[52] U.S. Cl. ..... 205/287; 210/735; 204/DIG. 13; 423/54

[58] Field of Search ..... 204/DIG. 13, 51; 423/54; 210/735; 205/287

[56] References Cited

U.S. PATENT DOCUMENTS

| | | | |
|---|---|---|---|
| 2,733,204 | 1/1956 | Costa | 423/54 |
| 3,998,924 | 12/1976 | Jones et al. | 423/24 |
| 4,031,038 | 6/1977 | Grinstead et al. | 423/24 |
| 4,963,264 | 10/1990 | Davis | 210/648 |
| 5,002,645 | 3/1991 | Fastland, Jr. et al. | 204/130 |

OTHER PUBLICATIONS

J. Gyllenspetz et al., "Trivalent Chromium Electroplating Baths and Electroplating Thereform", U.S. Pat. No. 3,954,574, Official Gazette May 4, 1976, p. 235.

J. Gyllenspetz et al., "Compositions For Use in Chromium Plating", U.S. Pat. No. 4,054,494, Official Gazette Oct. 18, 1977, p. 986.

J. Crowther et al., "Method of Regenerating A Chromium Electroplating Bath", U.S. Pat. No. 4,038,160, Official Gazette Jul. 26, 1977, p. 1741.

B. A. Bolto and L. Pawlowski, "Wastewater Treatment by Ion Exchange", *E. & R.N. Spon*, New York, 1987, pp. 39–48.

*Primary Examiner*—John Niebling
*Assistant Examiner*—Brian M. Bolam
*Attorney, Agent, or Firm*—Skjerven, Morrill, MacPherson, Franklin & Friel

[57] ABSTRACT

A new method for purification of trivalent chromium electroplating baths contaminated with cationic metal ions is disclosed. In this purification process, the contaminated trivalent chromium is passed at the pH level of the bath through one or more columns containing an ion-exchange resin having the picolylamine group as the functional moiety. The cationic metal ions are preferentially bound to the resin while the trivalent chromium is passed through the resin with substantially no adsorption thereby purifying the electroplating bath. This process is preferably performed simultaneously with the electroplating process.

14 Claims, 2 Drawing Sheets

METHOD FOR PURIFICATION OF TRIVALENT CHROMIUM ELECTROPLATING BATHS

BACKGROUND OF THE INVENTION

1. Field of the Invention

This invention relates generally to the removal of metal ion contaminants from an aqueous solution and in particular to removal of nickel, copper, zinc and other metal ions from a trivalent chromium electroplating bath.

2. Description of Prior Art

In the electroplating industry, baths containing concentrated metal ions are utilized in the plating process. The production materials, typically referred to as substrates, are immersed in a plating bath, and electric current is applied. The plating metallic ions in the bath are plated upon the substrates. Once sufficient metal is deposited on the substrate, the substrate is removed from the bath. The substrate is then rinsed in water tanks to remove adhering, non-plated metal ions. After rinsing, the substrate is advanced to the next plating bath. Many of the substrates which are plated are metallic. For example, decorative chrome is plated over substrates of copper, nickel or brass. Tin is plated on steel, and gold is plated on copper printed circuit boards.

A typical plating bath may have concentrations of plating metal ions that range from a few thousand to hundreds of thousands of parts per million (ppm). When the substrate metals are immersed in the plating baths, small amounts of metal, typically in the form of metal ions, may be stripped from the substrate. Over time these substrate metal ion contaminants accumulate in the plating bath. Concentrations of contaminant metal ions as low as 10–100 ppm may impair the plating process. When contaminant metal ions accumulate to levels which impair the plating process, the bath is either discarded or purified. Disposal of a spent plating bath results in loss of expensive plating chemicals and presents a real waste disposal problem.

The development of an economical purification process therefore would be highly advantageous. Purification of plating baths requires separation techniques which selectively remove low concentrations of the contaminant metal ions in the presence of very high concentrations of the plating metal ions.

Use of ion-exchange resins is a possible method for plating bath purification (See for example, B.A. Bolto and L. Pawlowski, in "Wastewater Treatment by Ion Exchange", E. & R.N. Spon, New York, 1987, p. 39–48). In fact, for a number of years cation exchange resins have been used to recover metal ion contaminants from hexavalent chromium plating and anodizing baths. In this instance, hexavalent chromium (an anion as chromate or dichromate) comprises the desired species in the mother bath. Upon use, the bath becomes contaminated with such impurities as $Fe^{+3}$, $Mg^{+2}$, $Al^{+3}$, $Cu^{+2}$, $Zn^{+2}$, and $Ni^{+2}$ as well as $Cr^{+3}$, which results from the reduction of $Cr^{+6}$ to $Cr^{+3}$. Although the baths are acidic with pH level usually below 1.0, a strong acid cation ion-exchange resin adsorbs the contaminating cationic metal impurities and passes the plating anions, i.e., the anionic hexavalent chromium.

Other plating baths, including pickling baths, have been purified by ion-exchange. In some metal finishing operations, acids are employed to clean the metal and strip the oxide layer from the surface of the metal. Accumulation of metal ions arising from the dissolution of the metal causes deterioration of such baths. The contaminated baths may be purified by methods similar to that outlined above for hexavalent chromium baths.

For example, magnesium sheet is pickled in an acetic acid bath. During the pickling operation, the increase in the magnesium ion $Mg^{+2}$ concentration coupled with the decrease in the acetic acid concentration results in progressively slower pickling rates. The spent pickle bath, i.e., the bath contaminated with magnesium ions, is purified by passing the bath through a cation exchange resin in the protonated form. This cation exchange resin exchanges magnesium ions for protons and the acetate anion passes through the resin. This results in rejuvenation of acetic acid in the pickling bath.

The above cited examples of bath purification are based upon the separation and removal of cationic impurities from desired anionic plating species. Purification of a plating bath containing cationic plating metal ions as well as cationic metal impurities is a much more difficult problem. A specific example of such a bath is a trivalent chromium plating bath marketed by Engelhard Corporation, of Cleveland, Ohio. This trivalent chromium plating bath contains from 0.1M to 1.2M (5,100–61,300 ppm) of $Cr^{+3}$ among other components, and operates at a pH between 1 and 4. (See for example, Gyllenspetz et al., U.S. Pat. No. 3,954,574 and Gyllenspetz et al., U.S. Pat. No. 4,054,494).

Once metal ion impurities such as zinc ($Zn^{+2}$), copper ($Cu^{+2}$) and nickel ($Ni^{+2}$) accumulate in the trivalent chromium plating bath to levels between 10 and 100 ppm, the quality of chromium plating becomes impaired. Typically, a trivalent chromium bath is then either dumped or purified by use of complex precipitating agents such as ferrocyanides, which precipitate the cationic metal impurities (See for example, Crowther et al., U.S. Pat. No. 4,038,160). The bath is then filtered to remove the precipitated impurities. This process uses environmentally undesirable reagents (ferrocyanides), is time consuming, and takes the bath out of production during the purification process. Thus, an environmentally acceptable method that selectively removes contaminating metal ions from a trivalent chromium plating bath on a continuous basis without interruption of the plating process is highly desirable.

The separation of trace amounts (tens of ppm) of divalent cationic metal ion impurities from high concentrations (many thousands of ppm) of the desired trivalent chromium ion is impossible with the use of a strong acid cation exchange resin. The functional group on a strong acid cation resin is a sulphonic acid moiety which interacts with cations primarily through electrostatic attraction. Thus, this type of resin has higher affinity for the more highly charged cationic species and therefore exhibits higher affinity for trivalent cations than for divalent cations.

Hence, while environmentally and economically desirable, an on-line method for purification of a trivalent chromium plating bath contaminated with cationic impurities is not available.

SUMMARY OF THE INVENTION

According to the principles of this invention, a cationic metal ion contaminated trivalent chromium plating bath is purified by use of a chelating ion-exchange resin having a high affinity for the cationic metal ion contaminants compared to the affinity for trivalent chromium. In one embodiment, the cationic metal ion contaminants are the divalent ions of copper, nickel, and zinc, but the purification process of this invention is equally effective when any one or any combination of such trivalent cationic metal ions are contaminants in the trivalent chromium plating solution.

According to the principles of this invention, a contaminated trivalent chromium bath is passed, preferably pumped, at the pH level of the bath through one or more columns containing a chelating ion-exchange resin having a picolylamine group as the functional moiety. The contaminant cationic metal ions are preferentially adsorbed by the resin, and the purified effluent from the column, which still contains the trivalent chromium, is passed back into the plating bath. Preferably, this purification process is performed on a continuous basis, and consequently purification of the contaminated bath does not require interruption of plating production.

When the chelating ion-exchange resin is saturated with bound contaminant metal ions, the contaminant metal ions are quickly stripped from the resin, and the resin put back into service. The purification process of this invention has the power to selectively recover trace amounts (tens of ppm) of copper, nickel and zinc in the presence of large amounts (many thousands of ppm) of trivalent chromium at the acidic operating pH of a trivalent chromium plating bath.

DETAILED DESCRIPTION

Figure 1:
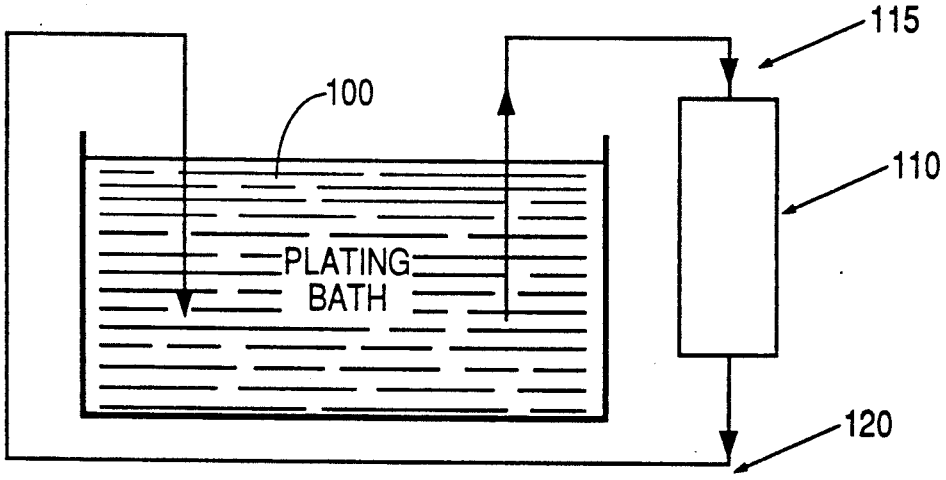
FIG. 1 is a schematic diagram of the purification process of this invention.

A new process for purification of trivalent chromium electroplating baths containing cationic contaminants such as $Cu^{+2}$, $Zn^{+2}$ and $Ni^{+2}$ using a chelating resin, preferably a chelating ion-exchange resin having the picolylamine group as the functional moiety, is disclosed.

The purification process entails passing a contaminated trivalent chromium electroplating bath at the pH level of the bath through one or more columns containing an ion-exchange resin such as a chelating ion-exchange resin having the picolylamine group as the functional moiety, preferably, the bis-picolylamine group. A chelating ion-exchange resin having the picolylamine group as the functional moiety is sold by Dow Chemical Co. of Midland, Michigan as XFS-4195 resin which has the bis-picolylamine group as the functional moiety. Other chelating ion-exchange resins having the picolylamine group as the functional moiety are the XFS-4196 resin and the XFS-43084 resin, both sold by Dow Chemical Co.

A chelating ion-exchange resin with the bis-picolylamine group as the functional moiety has a very high affinity, as described below, for copper, zinc and nickel even in the relatively acidic medium, preferably a pH of about 2 to about 4, of a trivalent chromium plating bath. Furthermore, we have determined that a chelating ion-exchange resin having the bis-picolylamine group as the functional moiety has little or no affinity for the chromium ion $Cr^{+3}$ in a trivalent chromium electroplating bath.

Thus, when the contaminated bath is processed with the chelating ion-exchange resin having the picolylamine group as the functional moiety, the contaminant concentrations are diminished. Initially, the purification is about 75 percent, preferably about 90 percent in one embodiment, but as the resin becomes saturated, the purification drops to about the 10 percent level. If removal of only 10 percent of the contaminants is not acceptable, the resin is simply rejuvenated, as described below, when the purification drops below a predetermined acceptable level. Here, an acceptable level means a level of contaminants in the bath such that the plating process is not impaired. In contrast, the concentration of the chromium ion in the effluent from the column is in the range of about 95 percent to 100 percent of the concentration in the influent to the column.

Affinity of an ion-exchange resin for an ion is normally defined by a distribution coefficient D. Distribution coefficient D is:

$$D=[R-M]/[M]_{soln}$$

where [R—M] represents the concentration of the metal adsorbed to the resin, usually specified as grams of metal per gram of resin, and $[M]_{soln}$ represents the concentration of metal ion in the solution passed over the resin. A distribution coefficient is measured by contacting a resin with a metal ion containing solution and then analyzing the solution concentration of the metal ion after equilibrium has been reached. A distribution coefficient greater than one means that the resin has a high affinity for the metal ion in question. A distribution coefficient of near zero means that the resin has little affinity for the metal ion, while a distribution coefficient of zero means that the resin has no affinity for the metal ion.

Therefore, according to the principles of this invention, any ion-exchange resin that has a distribution coefficient of about one or greater, i.e., a high affinity, for cationic plating bath contaminants such as copper, nickel and zinc, and a distribution coefficient of near zero, about 0.05 or smaller, preferably about zero, i.e., a low affinity, for the plating metal ion, may be used in the plating bath purification process of this invention.

In one embodiment, a contaminated trivalent chromium plating bath 100 (FIG. 1) is pumped through one or more columns 110 containing XFS-4195 resin at a flow rate preferably in the range of about 10 to about 40 bed volumes per hour. The rate of flow through the resin is not critical, in that faster flow rates can be used with some diminution in performance. The exact nature of piping, valving and pumps is well known to one skilled in the art of the use of ion-exchange technology, and is determined by the volume of the bath, the frequency of plating operations, the composition of the substrates plated, and the required purity of the bath, for example.

The cationic contaminant metal ions, copper, zinc and nickel ions, are complexed and adsorbed, i.e., bound, by the XFS-4195 resin in columns 110. Effluent 120 from the XFS-4195 resin containing column or columns 110 is directed back into plating bath 100 with little or no diminution in trivalent chromium concentration and considerable diminution in cationic contaminant metal ion concentration levels. Hence, plating bath 100 is purified without interrupting plating production. This on-line purification process is economically and environmentally better than the prior art methods described above.

Once the XFS-4195 resin becomes saturated with bound contaminant metal ions, as determined by chemical analysis of the effluent, service flow (i.e., pumping of the bath through the column or columns) is discontinued. The contaminant metal ions are then stripped from the XFS-4195 resin by passage of reagents, as described more completely below, through the column or columns, and then service flow is reinstituted.

Normally, the plating production can continue while the chelating ion-exchange resin is being stripped. However, if continuous purification is required, a plurality of parallel columns is provided. In this embodiment, when the resin in some of the columns is being rejuvenated, the other columns are used to continue the purification process.

In one embodiment, stripping of the contaminant metal ions from the chelating ion-exchange resin having the bis-picolylamine group as the functional moiety was accomplished by passage, in sequence, of five bed volumes of 1.0M $NH_4OH$, two bed volumes of water, five bed volumes of 1.0M $H_2SO_4$ and ten bed volumes of water. The bound copper and the majority of the bound zinc were recovered with the ammonium hydroxide strip while small amounts of bound copper and zinc and the majority of the bound nickel were recovered by the sulfuric acid strip.

In another embodiment, stripping of contaminant metals bound to the chelating ion-exchange resin having the bis-picolylamine group as the functional moiety was accomplished by the passage through the column of 10 bed volumes of EDTA (ethylenediaminetetraacetic acid) and tetraethylenepentamine, both of which are strong chelating agents.

In yet another embodiment, stripping of the bound contaminate metals was accomplished by the sequential treatment with five bed volumes of 1.0M sulfuric acid, two bed volumes of water and five bed volumes of either 1.0M ammonium hydroxide or 0.5M EDTA and 0.1M tetraethylenepentamine. The bound nickel and zinc were quantitatively stripped by the acid and the bound copper was stripped by the chelating agents or ammonia.

Stripping agents may include any strong mineral acid such as sulfuric or hydrochloric acid. Dilute mineral acids, about 1.0M, are effective for stripping contaminants such as nickel and zinc, but since copper is bound to the resin so strongly, either more concentrated, mineral acids, about 5.0M, or strong complexing agents are required to strip the copper. In addition to ammonia, EDTA and tetraethylenepentamine, other chelating agents which have affinities for copper which are equal to or higher than that of ammonia or EDTA should be effective stripping agents. Such chelating agents for copper stripping include triethylenetetramine, diethylenetriamine, ethylenediamine, phenanthroline and diethylenetriaminetetraacetic acid.

As described above, the purification process of this invention requires an ion-exchange resin, which has high affinity for copper, nickel and zinc ions and negligible affinity for trivalent chromium, such as a chelating ion-exchange resin with the picolylamine group as the functional moiety, preferably the bis-picolylamine group. In general, chelating ion-exchange resins have specific functional groups which can coordinate directly to transition metal ions through formation of covalent bonds. A chelating resin may have the power to discriminate among transition metal ions based upon the difference in chemical reactivity of those ions.

A very common chelating resin that is used in the electroplating industry today has the iminodiacetate functional group (available as IRC-718 from Rohm and Haas, Philadelphia, PA or as SR-5 from Sybron Chemical, Birmingham, NJ). This resin has high affinity for many transition metal ions because the two carboxyl groups and the imino group of each iminodiacetate functionality can coordinate in a tridentate manner to transition metal ions. However, this resin was ineffective for removing the cationic divalent metal ion impurities from a trivalent chromium plating bath. See Example 6 below. This may have been because of the very high ionic strength and relatively low pH of the plating bath, both of which tend to interfere with the binding of transition metal ions to chelating resins. Nevertheless, the purification process of this invention provides the unexpected result of preferentially removing cationic divalent metal ion impurities from a trivalent chromium plating bath using a chelating ion-exchange resin having the picolylamine group as the functional moiety.

The principles of this invention are further illustrated by the following examples.

EXAMPLE 1

A sample of Engelhard Corporation's Tri-Chrom Plus electroplating solution was obtained. According to the manufacturers technical literature, the tri-chrome plating bath contains approximately 20,000 ppm of trivalent chromium and has an operating pH of between about 2.3 and about 2.9. Additional proprietary chemicals were also in the bath. The pH of the bath sample obtained for these studies was 2.84. The bath was spiked with $Cu^{+2}$ (as $CuSO_4.5H_2O$), $Ni^{+2}$ (as $NiSO_4.6H_2O$) and $Zn^{+2}$ (as $ZnCl_2$) to simulate contamination. Final concentrations of contaminate metal ions were 20 ppm Cu, 43 ppm Ni and 18 ppm Zn. The spiked trivalent chromium plating solution was pumped through a column (0.7 cm, i.d.) containing 5 mL of XFS-4195 resin at a flow rate of 20 bed volumes (100 mL) per hour.

Figure 2:
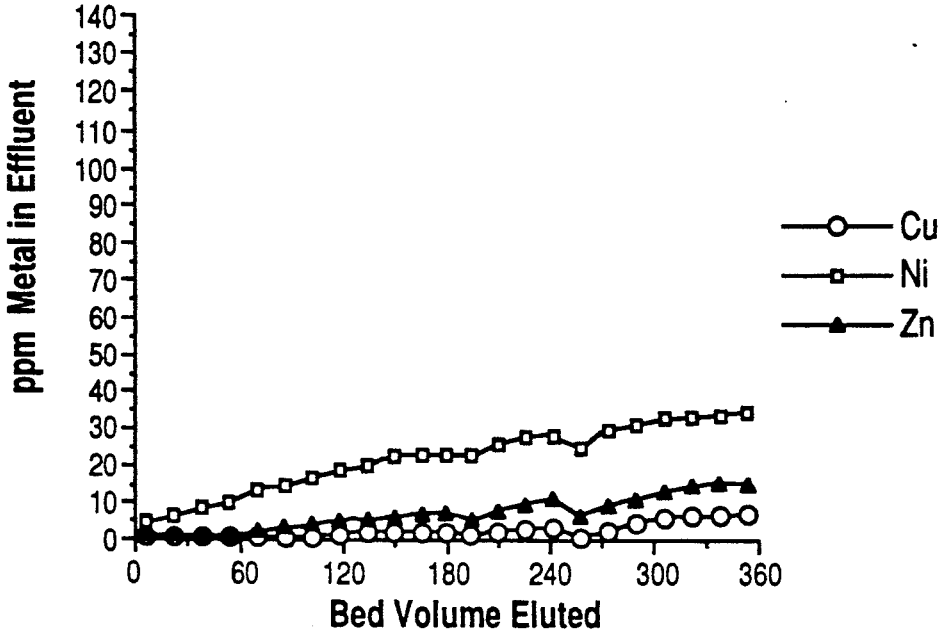
FIG. 2 is a graph illustrating the effectiveness of the purification process of this invention.

Two bed volume fractions (10 mL) were collected using an automatic fraction collector, and each fraction was analyzed for copper, nickel and zinc by atomic absorption spectroscopy. FIG. 2 shows the results of effluent fractions analysis. Even after the passage of 360 bed volumes of the spiked tri-chrome plating bath through the column, the column was still not saturated with copper, nickel or zinc.

Also, as shown in FIG. 2, the contaminant removal was initially at least 90% effective. Specifically, about 5 ppm of the 43 ppm of nickel were passed through the column. Hence, about 40 ppm was adsorbed. After 360 bed volumes, about 8 ppm of the 43 ppm of nickel was adsorbed. Hence, the removal was about 20% after 360 bed volumes, i.e. the purification was about 20%. The purification for copper and zinc was better than that for nickel so that in this embodiment, the nickel concentration was the limiting factor in the purification process.

After processing 360 bed volumes, passage of the trivalent chromium plating solution through the column was stopped, the column was flushed with water and then stripped of spiked metal ions by the sequential passage of five bed volumes of 1.0M ammonium hydroxide, two bed volumes of water, and five bed volumes of 1.0M sulfuric acid, all at flow rates of 20 bed volumes per hour. Fractions containing two bed volumes each (10 mL) of the stripping solutions were collected and analyzed for copper, nickel, zinc and chromium.

Figure 3:
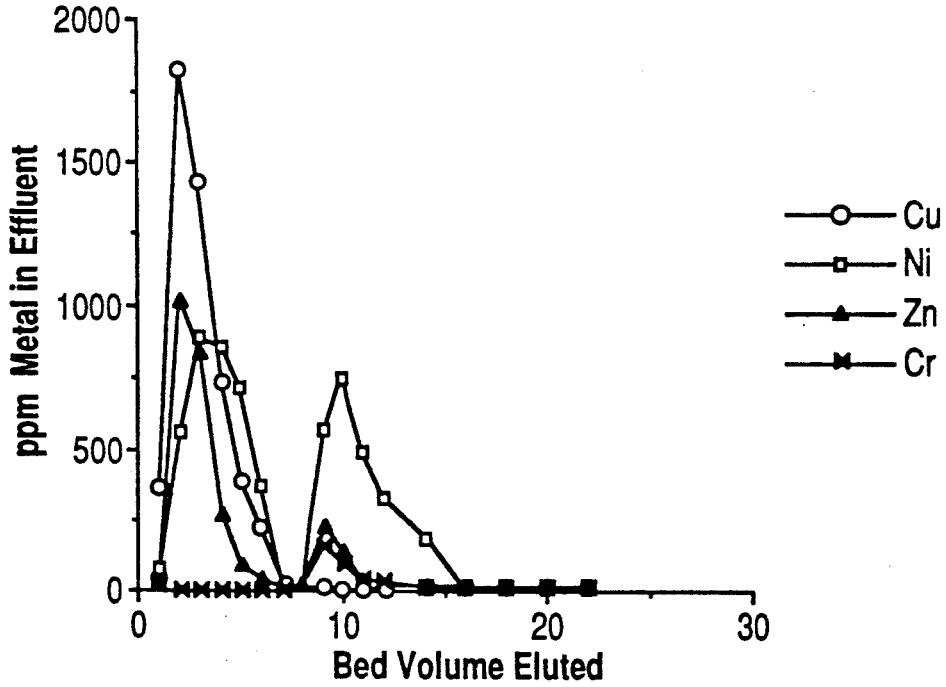
FIG. 3 is a graph illustrating the recovery of contaminants bound to the ion-exchange resin in the purification process of this invention.

Results shown in FIG. 3 indicate substantially no chromium was recovered in the stripping procedure. Mass balance calculations showed substantially all the copper was recovered in the ammonia strip whereas nickel and zinc were recovered in both the ammonia and acid strips. Mass balance calculations also showed substantially quantitative (95–100 percent) recovery of copper, nickel and zinc.

EXAMPLE 2

The procedure, as described in Example 1, is carried out with the exception that the spiked trivalent plating solution is pumped through a column containing the XFS-4196 resin. The contaminant removal is 75% effective. The procedure of Example 1 is repeated again except this time the spiked trivalent plating solution is pumped through a column containing the XFS-43084 resin. The contaminant removal is 75% effective.

EXAMPLE 3

The same procedure as described in Example 1 was carried out with the exception that the spiked trivalent chromium plating solution was pumped through the column at a flow rate of 10 bed volumes per hour instead of 20 bed volumes per hour. Analysis of the effluents resulted, within experimental error, in data similar to that shown in the faster flow rate. Stripping of $Cu^{+2}$, $Ni^{+2}$ and $Zn^{+2}$ was accomplished according to the stripping procedure in Example 1 with essentially identical results as seen in FIG. 3.

EXAMPLE 4

The same procedure, as described above in Example 1, was carried out for passage of 100 bed volumes of spiked trivalent chromium plating solution through a column of XFS-4195 resin. Stripping was accomplished by passage of ten bed volumes of 1.0M sulfuric acid through the column at a flow rate of 20 bed volumes per hour. One single 50 mL (ten bed volume) stripping faction was collected and analyzed for copper, nickel and zinc. Analysis showed the following recovery: nickel 96 percent, zinc 97 percent, copper 8 percent. This acid stripping procedure is excellent for nickel and zinc but poor for copper.

EXAMPLE 5

The procedure outlined in Example 4 was followed to load the column with contaminants in the spiked trivalent chromium plating bath. After loading, the column was stripped at a flow rate of 20 bed volumes per hour with 10 bed volumes of a solution containing 0.1M EDTA and 0.1M tetraethylenepentamine. Analysis of stripping effluents showed complete recovery of copper, nickel and zinc with the majority of the metal ions being stripped within the first 4 bed volumes.

EXAMPLE 6

This example illustrates that other chelating ion-exchange resins are ineffective in simultaneously removing copper, nickel and zinc ions from a trivalent chromium plating bath. A strong acid cation resin (MSC-1 from Dow Chemical Co., Midland, Michigan), and a chelating resin (SR-5 from Sybron Chemical, Birmingham, NJ), were tested according to the procedures described in Example 1. While SR-5 was somewhat effective in removing copper impurities from the trivalent chromium plating bath, neither resin was effective in removing all three metal ion impurities (Cu, Zn, Ni) from the bath as compared to XFS-4195 in Example 1. Data for the performance of these resins is shown in Table 1.

TABLE 1

Performance of Ion-exchange Resins in Removing Copper, Nickel and Zinc Impurities from a Trivalent Chromium Plating Bath Resin and Concentration of Metals in Effluent (ppm)

| | MSC - 1 | | SR - 5 | | |
|---|---|---|---|---|---|
| | Cu | Ni | Cu | Ni | Zn |
| Bed Volume of Effluent | | | | | |
| 2 | 2.3 | 5.9 | 0.9 | 5.3 | 7 |
| 4 | 18.4 | 71 | 1.2 | 16 | 21 |
| 6 | 26 | 98 | 1.7 | 36 | 27 |
| 8 | 26 | 102 | 2.9 | 57 | 29 |
| 10 | 26 | 103 | 3.1 | 70 | 26 |
| 12 | 26 | 103 | 4.1 | 79 | 29 |
| 14 | 27 | 104 | 5.0 | 86 | 30 |
| 16 | 27 | 103 | 5.1 | 91 | 28 |
| 18 | 26 | 102 | 5.8 | 94 | 31 |
| 20 | 26 | 102 | | | |
| 22 | | | | | |
| 24 | | | | | |
| Concentration of Influent | 26 | 101 | 26 | 106 | 31 |

We claim:

1. A method for purification of a trivalent chromium solution contaminated with cationic metal ions comprising:

contacting said solution with a chelating ion-exchange resin having the picolylamine group as the functional moiety so that said resin has a high affinity for the contaminant cationic metal ion and substantially zero affinity for cationic trivalent chromium metal ions wherein contaminant cationic metal ions are bound by said chelating ion-exchange resin thereby purifying said solution.

2. The method of claim 1 wherein said contaminated trivalent chromium solution is an electroplating bath.

3. The method of claim 2 further comprising the step of returning effluent from the chelating ion-exchange resin to the electroplating bath.

4. The method of claim 3 further comprising the step of:

isolating the chelating ion-exchange resin from the electroplating bath.

5. The method of claim 4 wherein the chelating ion-exchange resin is isolated from the electroplating bath upon said purification decreasing to a predetermined level.

6. The method of claim 4 further comprising the step of:

contacting reagents with said chelating ion-exchange resin thereby regenerating said chelating ion-exchange resin for continued use in said purification process.

7. The method of claim 1 or claim 6 wherein said chelating ion-exchange resin having the picolylamine group as the functional moiety is a chelating ion-exchange resin having the bis-picolylamine group as the functional moiety.

8. The method of claim 7 wherein said chelating ion-exchange resin is XFS-4195 resin.

9. The method of claim 7 wherein at least 95 percent of the cationic trivalent chromium metal ions pass through said chelating ion-exchange resin.

10. The method of claim 7 wherein 10 to 90 percent of the cationic metal ion contaminants are bound to said chelating ion-exchange resin.

11. The method of claim 7 wherein said contaminant cationic ions include at least one of the ions in the group consisting of copper, nickel and zinc ions.

12. The method of claim 7 wherein said reagents are a mineral acid and ammonium hydroxide.

13. The method of claim 7 wherein said reagents include complexing agents having a higher affinity for bound contaminant cationic ions than the affinity of said chelating ion-exchange resin for said contaminant cationic ions.

14. The method of claim 13 wherein said complexing agents comprise EDTA and tetraethylenepentamine.

* * * * *